United States Patent [19]

Hay et al.

[11] Patent Number: 4,634,453

[45] Date of Patent: Jan. 6, 1987

[54] CERAMIC BONDED GRINDING WHEEL

[75] Inventors: John Hay, Shrewsbury; Leonard I. Smith, Princeton; George E. Foster, Dudley, all of Mass.

[73] Assignee: Norton Company, Worcester, Pa.

[21] Appl. No.: 736,158

[22] Filed: May 20, 1985

[51] Int. Cl.[4] ..... B24D 3/00

[52] U.S. Cl. ..... 51/293; 51/295

[58] Field of Search ..... 51/293, 295

[56] References Cited

U.S. PATENT DOCUMENTS

| | | | |
|---|---|---|---|
| 2,377,995 | 6/1945 | Coes, Jr. | 51/295 |
| 2,584,862 | 2/1952 | Garrison | 51/295 |
| 3,369,879 | 2/1968 | Miller | 51/293 |
| 3,415,635 | 12/1968 | Hallewell | 51/293 |
| 3,615,304 | 10/1971 | Caserta et al. | 51/293 |
| 3,756,796 | 9/1973 | Miller | 51/293 |
| 3,794,474 | 2/1974 | Megens | 51/295 |
| 3,986,847 | 10/1976 | Balson | 51/308 |
| 4,131,436 | 12/1978 | Wiand | 51/295 |
| 4,157,897 | 6/1979 | Keat | 51/295 |
| 4,246,004 | 1/1981 | Busch et al. | 51/295 |

*Primary Examiner*—Paul Lieberman
*Assistant Examiner*—Willie J. Thompson
*Attorney, Agent, or Firm*—Rufus M. Franklin

[57] ABSTRACT

A method for making grinding wheels having an annular grinding section mounted on a central hub in which a slurry of abrasive particles and ceramic bond is coated on a pre-formed core, shaped, and fired. Method has particular advantage in formation of wide wheels and contoured wheels. Premium abrasive may be employed in the wheels.

6 Claims, 2 Drawing Figures

CERAMIC BONDED GRINDING WHEEL

FIELD OF THE INVENTION

This invention relates to novel ceramic bonded grinding wheels and to a method of making them.

BACKGROUND OF THE INVENTION

Ceramic bonded grinding wheels and tools such as honing sticks (also referred to as glass bonded or vitreous bonded, or vitrified), have been made by pressing wetted mixtures of bond and abrasive in a closed mold to form a "green" (unfired) shape which is sufficiently strong to maintain its shape, while supported on the bottom only, during the firing operation which softens (matures) the glass so that upon cooling to room temperature, a strongly bonded wheel is produced. Sometimes, particularly when expensive "superabrasive" grits (diamond or cubic boron nitride) are employed in an annular grinding section (rim type wheels), the grinding section is still formed by pressing in a closed mold, but is attached to a ceramic center or core.

Making vitrified wheels or hones by the casting of a mix into open molds, without pressure, is an older method, which has been replaced by the cold pressing technique in closed molds.

One difficulty with the cold pressing method, particularly when wide rim wheels are made, is lack of uniform density across the axial width of the rim, due to the fact that with conventional equipment the pressure must be applied uniaxially. Another difficulty is the expense of molds and the difficulty of filling the molds.

The present invention provides a method for making rim-type ceramic bonded wheels without the use of molds. It is particularly suited to the manufacture of superabrasive wheels and to wide wheels.

BRIEF DESCRIPTION OF THE INVENTION

Rim type grinding wheels, which may contain any type of abrasive grit, but particularly cubic boron nitride or diamond or mixtures thereof or mixtures with other abrasive grits, are formed in the instant invention, by coating a slurry or slip of the desired abrasive and ceramic bonding material onto the circumferential surface of a pre-formed porous core. The porosity of the core aids in bonding of the abrasive section and, if required, allows a vacuum to be applied through a center hole in the core, aiding in the formation of the slurry coating on the periphery. Any of the conventional ceramic bonds may be employed. The bond must be compatable with the core material; for example, it should not be so different in thermal expansion coefficient as to cause cracking or breakage during firing, cooling, or use of the wheel. The bond composition should be sufficiently strong after drying, but before firing, to be self sustaining during handling, and to permit forming or shaping operations to be performed on the green (unfired) coating.

Figure 1:
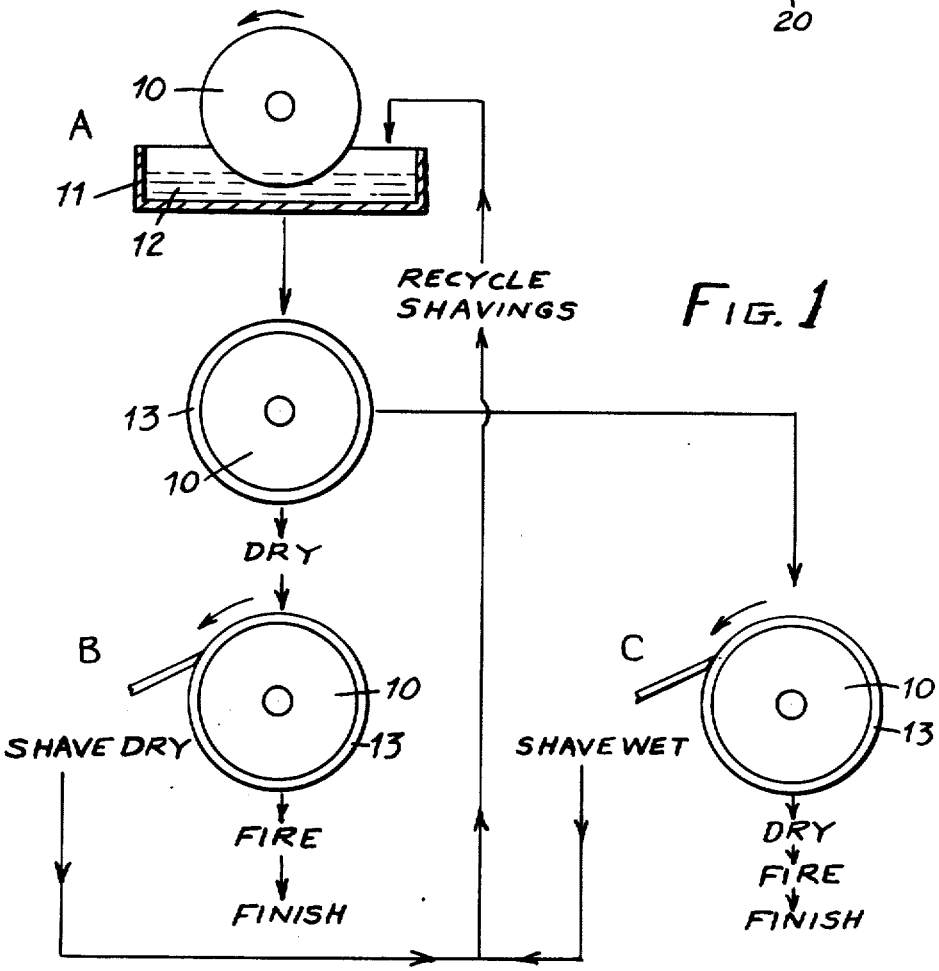
FIG. 1 is a schematic diagram of the process.

In FIG. 1 is shown a schematic of the process. At A, a slurry is coated on the wheel core 10 rotating while partially submerged in a container 11 of slurry 12. From coating operation A, the coating may be dried, and then shaved as at B to true its surface, and finally fired to mature the ceramic bond. Alternatively, the wheel may be shaped before completion of drying, as at C, and then fired. After firing further conventional finishing operations such as further truing, bushing, etc. can be performed. The shaving operation may include formation of a desired contour on the wheel face for grinding of special shapes such as screw threads, shoulders and grooves. In most cases, and particularly when deep or complex shaping is involved, a shape, paralleling the final shape of the outside of the abrasive rim, should be formed on the outer surface of the core prior to coating with the abrasive and bond mixture.

DESCRIPTION OF SPECIFIC EMBODIMENT OF INVENTION

Figure 2:
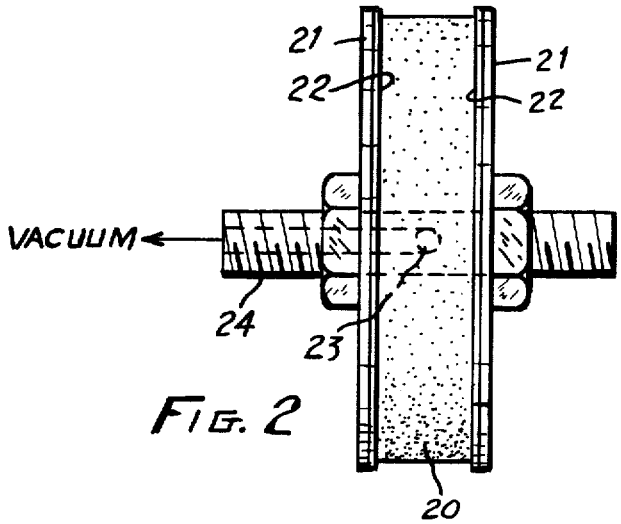
FIG. 2 shows the mounting of a core to be coated in accordance with the invention.

A small, ceramic bonded wheel, containing 60 grit fused alumina abrasive and a ceramic bond, ¾ inch in diameter, ¾ inch thick, and having a ¼ inch hole through its center, was mounted between two ⅞ inch diameter aluminum flanges from which it was separated by two rubber gaskets of the same diameter. FIG. 2 shows the core 20, flanges 21, and gasket 22. The core was positioned over a hole 23 on spindle 24. The hole 23 communicates with bore 25 which is connected to a vacuum pump.

While being rotated at about 12 rpm by means of a variable speed electric motor and reducing gear, the core was filled with water to the point of saturation. A small trough containing a water suspension of the rim composition was raised below the wheel so that the wheel dipped into it, and a vacuum slowly drawn to initiate the casting of the rim. The required vacuum was adjusted depending on visual observation of the casting progress and was generally in the range of 1/6 to ½ atmosphere. After the entire face of the wheel was coated to a depth slightly greater than side flanges, the trough was lowered away and the rotation of the wheel under vacuum continued until the rim achieved-rigidity. The rim wheel was then removed from the fixture, dried, and subsequently shaved to bring the periphery of the wheel concentric with the core. After firing the composite wheel the bond in the rim was found to be matured and the rim was securely attached to the core.

As shown in the schematic FIG. 1 the exterior face of the rim can be shaved concentric with core before being completely dried. Depending upon the particular physical properties of the abrasive-bond mix and the desired properties of the fired wheel, the abrasive coating may be further compacted by use of a roller, or it may be isostatically pressed by use, for example, of a flexible film conforming to the shape of the wheel and urged against the wheel by fluid pressure. Pore inducing agents such as burnout material, volatizable material of porous particles can be included in the bond abrasive mix to control porosity of the final product.

Rims up to 9/16" in thickness have been produced by this process but it is particularly suited to rims of 1/16" and less in thickness where mold filling and tooling problems make conventional pressing difficult. The procedure overcomes pressure gradient problems associated with rim wheels made by conventional uniaxial pressing and is applicable to wheels several inches in thickness. The process also permits a shape to be machined in the face of the core, and conformity with the shape is closely approximated in the rim as cast, with slight and predictable change after firing.

Conventional ceramic bonds, compatable with the abrasive chosen, can be used in the slurry which is coated on the core. For diamond, for example, lower temperature maturing bonds may be employed for diamond abrasives. Suitable such glass compositions are given in U.S. Pat. Nos. 4,157,897, and 3,986,847. Unless the ceramic composition used to make the bond-abrasive mix contains material such as clay to provide green strength, it is necessary to add a starch, gum, or similar binder, to provide green strength for the cast rim.

A suitable slurry for casting a rim can be made by mixing:

| | |
|---|---|
| 0.5% xanthan gum solution | 9.41 cc |
| Water | 9.41 cc |
| Cubic Boron Nitride (180 grit size) | 8.92 g |
| Fused White aluminum oxide (150 grit) | 28.72 g |
| Fritted, powdered glass bond | 13.59 g |

If separation of the bond solids by being excessively drawn into the pores of the core is a problem, the bond may be adhered to the surface of the abrasive grits by an adhesive such as a synthetic rubber latex, the precoated grit-bond particles then being mixed with a liquid and a thickening agent to facilitate coating of the mixture on the core.

A suitable composition for coating abrasive grits (180 grit size) is composed of a 50% solid Hycar 26120 acrylic latex, available from B. F. Goodrich, Cleveland, Ohio. The latex in the amount of 0.035 grains/gram of abrasive is mixed with water in the amount of 0.008 grams/gram of abrasive, and the ceramic bond, in the amount of 0.4 grams/gram of abrasive is added. The mixture is then spread on a flat surface to dry, and air dried for 2 hours at room temperature. The partially dried mix is then screened to insure separation of the particles, oven dried for 4 hours at 75° C. and then rescreened. The mix is then suspended in a 0.5% solids xanthan gum aqueous solution comprising 36% by weight of the total mixture. Additional water (about 15%) is added to adjust the viscosity of the mixture. Finally, the mixture, after degassing in a vacuum chamber, is ready for use in the invention.

Many modifications may be made in the processes as will be evident to those skilled in the art. Modification can be made in the particular bond materials, and in the organic constituents, and non-aqueous solutions may be substituted for aqueous solutions.

The wheels of this invention, instead of having the abrasive applied to the cylindrical periphery, may have the abrasive applied to all or a portion of the outer side face so that the plane of the abrasive surface is perpendicular to the axis of rotation as in cup wheels or disc type wheels.

Where honing sticks are made, the abrasive slurry is applied to the working surfaces of the hone.

The hub or core member may be a prefired vitrified wheel, which is generally preferrable, but may also be unfired or partly fired when the abrasive slurry is applied. Conventional abrasive vitrified wheels are particularly suited as cores or hubs for the invention.

What is claimed is:

1. A method for making vitrified bonded grinding tools comprising coating a slip of abrasive and vitreous bond on a peripheral surface of a porous ceramic hub member while drawing a vacuum through said surface, conforming the surface of said coating to a desired shape, and firing said coating to produce a vitreous bonded grinding annulus on said hub.

2. A method in claim 1 in which said coating contains an abrasive selected from the group consisting of diamond and CBN and combinations with each other or with other abrasives.

3. A method as in claim 1 in which the hub member is prefired.

4. A grinding wheel produced by the method of claim 1.

5. A method as in claim 1 in which said surface is a side surface.

6. A method as in claim 1 in which said surface is a cylindrical surface.

* * * * *

UNITED STATES PATENT AND TRADEMARK OFFICE

CERTIFICATE OF CORRECTION

PATENT NO. : 4,634,453

DATED : January 6, 1987

INVENTOR(S) : John Hay et al

It is certified that error appears in the above-identified patent and that said Letters Patent is hereby corrected as shown below: Title page:

Address of Assignee is Worcester, MA

Signed and Sealed this

Fourteenth Day of June, 1988

*Attest:*

DONALD J. QUIGG

*Attesting Officer*

*Commissioner of Patents and Trademarks*